US009908744B2

(12) United States Patent
Ekström

(10) Patent No.: US 9,908,744 B2
(45) Date of Patent: Mar. 6, 2018

(54) ELEVATOR GUIDE RAIL FIXING CLIP

(71) Applicant: KONE Corporation, Helsinki (FI)

(72) Inventor: Benjamin Ekström, Espoo (FI)

(73) Assignee: KONE CORPORATION, Helsinki (FI)

( * ) Notice: Subject to any disclaimer, the term of this patent is extended or adjusted under 35 U.S.C. 154(b) by 71 days.

(21) Appl. No.: 15/089,187

(22) Filed: Apr. 1, 2016

(65) Prior Publication Data

US 2016/0311654 A1 Oct. 27, 2016

(30) Foreign Application Priority Data

Apr. 23, 2015 (EP) ..... 15164791

(51) Int. Cl.
*B66B 7/02* (2006.01)
*B66B 19/00* (2006.01)

(52) U.S. Cl.
CPC ..... *B66B 7/024* (2013.01); *B66B 19/002* (2013.01)

(58) Field of Classification Search
CPC ..... B66B 7/02; B66B 7/024; B66B 19/002; E21D 7/02; E01B 9/34; B66C 7/08
See application file for complete search history.

(56) References Cited

U.S. PATENT DOCUMENTS 1,925,867 A * 9/1933 Dunlop ..... B66B 7/02 187/408
3,982,692 A 9/1976 Feyrer et al.
4,431,087 A * 2/1984 Karol ..... B66B 7/024 187/408
5,316,108 A * 5/1994 Pearson ..... B66B 7/024 187/408
6,991,070 B1 * 1/2006 Sanz Gamboa ..... B66B 7/026 187/406
2007/0172311 A1 * 7/2007 Sanz Gamboa ..... B66B 7/02 403/252

FOREIGN PATENT DOCUMENTS

ES 2 492 791 A1 9/2014
JP 2010-179993 A 8/2010
WO WO 90/15009 A1 12/1990
WO WO 2008/023406 A1 2/2008

* cited by examiner

*Primary Examiner* — Gisele Ford
(74) *Attorney, Agent, or Firm* — Birch, Stewart, Kolasch & Birch, LLP

(57) ABSTRACT

An elevator guide rail fixing clip has a u-shaped clip body configured to encompass a side edge of an elevator guide rail and a fastening element. The fastening element is fastened to the clip body and is configured to mount the clip body to a fixed structure of an elevator runway. The clip body includes a base wall, a side wall and a cover wall forming the three members of the u-shaped body. At least one of these walls has at least one projection protruding from the respective wall configured to contact the guide rail, which projection has a contact face for contact with the elevator guide rail. The fixing clip allows the fastening of a guiderail in a horizontal plane but with reduced friction against vertical sliding of the guide rail to compensate for building shrinkage.

16 Claims, 2 Drawing Sheets

ELEVATOR GUIDE RAIL FIXING CLIP

BACKGROUND OF THE INVENTION

The present invention relates to an elevator guide rail fixing clip which is used in connection with a fixing bracket to secure a guide rail in the elevator runway, particularly an elevator shaft.

DESCRIPTION OF THE RELATED ART

Usually, a fixing bracket comprises two fixing clips each of which gripping one of both side edges of the guide rail to secure it at a fixed structure in the elevator runway. An elevator guide rail installation faces the problem that a building normally has a certain shrinkage over the time so that the guide rails might buckle or bend when these are immovably fixed in the fixing clips. From the ES 2 492 791 A1, an elevator guide rail fixing clip is known which consists of two parts, namely a base plate to which a clamp member can be fastened via a screw. The contact area between the parts of the fixing clip which come in contact with the guide rail is reduced by providing projections which have a certain linear extension or a certain circular extension as to reduce the overall contact area with the guide rail. This allows an easier sliding of the guide rail in the fixing clip in case of building shrinkage. Anyway, the resistance to sliding is not reproducible because it depends on the force which presses the clamping part against the base part of the fixing clip.

SUMMARY OF THE INVENTION

It is therefore object of the invention to create an elevator guide rail fixing clip which allows the sliding of the guide rail due to building shrinkage and which safely fixes the guide rail to a fixed structure in the elevator runway and which is easy to handle.

The object is solved with an elevator guide rail fixing clip according to claim 1. Preferred embodiments of the invention are subject-matter of the dependent claims.

Some inventive embodiments are also discussed in the descriptive section of the present application and are shown in the drawings. The inventive content may also consist of several separate inventions, especially if the invention is considered in the light of expressions or implicit subtasks or from the point of view of advantages achieved. In this case, some of the attributes contained in the claims below may be superfluous from the point of view of separate inventive concepts.

According to the invention, the fixing clip has a—preferably one-piece—u-shaped clip body configured to encompass a side edge of an elevator guide rail. The clip body comprises a base wall to which a fastening element is connected configured to mount the guide rail fixing clip to a fixed structure. A sidewall is fixed to the base wall along a first edge of the base wall and a cover wall is fixed to the side wall at a second edge which second edge is parallel to the first edge. The cover wall and/or the base wall and/or the side wall have at least one projection protruding from the respective wall which projection has a contact surface for contact with the elevator guide rail.

Preferably, the contact face is punctual or a line. Both contact areas minimize the friction force between the guide rail and the fixing clip, whereby the punctual surface even has slight advantages over the line contact surface.

In contrast to ES 2 492 791 where the fixing clip has two body parts which are clamped to each other, the inventive fixing clip of the present invention has a u-shaped clip body in which the three members of the U (base wall, side wall and cover wall) are in a fixed (geometrical) relationship to each other. Preferably, only the fastening element is fastened to the clip body, which fastening element is used to mount the fixing clip to a guide rail fixing bracket or to a fixed structure in the elevator runway, particularly in the elevator shaft. Preferably, the fastening element is a screw bolt with a sphere segment head, which screw bolt is passed through a perforation in a wall of the clip body, preferably the base wall. The bolt head rests against the surface of the wall and then forms the projection for contacting the guide rail. The base wall is configured to be located next to the fixed structure to which the clip body is fastened, e.g. a bracket member of a guide rail fixing bracket. As the body is u-shaped, and its walls therefore are in a fixed geometrical relationship to each other the force acting on the guide rail when encompassing a side edge of the guide rail is always the same and is not dependent on any tightening forces of a clamping screw. Therefore, the tightening force of the fastening element does not have any impact on the clamping force of the fixing clip with respect to the guide rail.

Furthermore, the provision of a preferably punctual contact face with the guide rail reduces the mutual contact area between the fixing clip and the guide rail which facilitates vertical sliding of the guide rail in the fixing clip, for example due to building shrinkage. Therefore, any bending and buckling of the guide rails is effectively avoided.

Preferably, the u-shaped clip body comprising the base wall, the side wall and the cover wall is a one piece part. The clip body can therefore be manufactured by bending of a metal sheet. The clamping properties with respect to the guide rail are thus always the same provided that the projections of the base wall, of the side wall and of the cover wall come in contact with the guide rail which indicates a proper mounting of the fixing clip. By this means it is further ensured that the clamping force of the clip with respect to the guide rail is not dependent on any tightening means which define a clip body.

Preferably, the one piece part is a metal sheet with a thickness of preferably 2 to 15 mm, particularly 3 to 10 mm. Such a clip body can easily be produced and is rigid enough to securely fix the guide rail in the horizontal plane.

In a preferred embodiment, the one piece part is a spring metal sheet which therefore provides a determined elastic and reproducible clamping force to the guide rail edge via the projections of the base wall and cover wall, which are preferably located opposite to each.

Preferably, the base wall, the cover wall and the side wall have a projection each. By this measure, the proper mounting of the clip can easily be verified by all three projections being in contact with the guide rail. Although it is possible that each of these walls have one two, three or more projections, it is preferable, that each wall has only one projection, which reduces the overall contact area and thus the friction between guide rail and fixing clip.

Preferably, the distance between the cover wall and the base wall is in the area of a free edge of the cover wall opposite to the second edge equal or smaller than the mutual distance between the base wall and the cover wall in the area of the second edge. Via this measure, it is obtained that the cover wall and base wall are either parallel to each other or are inclined a little bit in a clip-like manner so that the open side between the base wall and cover wall is a little bit smaller than the width of the side wall. This enables a secure grip of the side edge of the guide rail by the fixing clip.

Preferably, the fastening element is a bolt which can easily be used to mount the fixing clip to a fixed structure. In this case, preferably the bolt head forms the projection of the base wall whereby the bolt head is preferably a sphere segment. With this embodiment, the fastening element realizes two functions, namely the mounting of the fixing clip to a fixed structure as well as to provide a punctual contact face for the guide rail. Whereas the fixing is realized with the bolt shaft, the provision of the punctual contact face is provided with the sphere segment bolt head.

Although other geometries may be used for the projection of the base wall and/or cover wall and/or side wall, e.g. a cone, preferably the projection is a sphere segment, which allows the transmission of considerable force without violating the surface of the guide rail. The advantage of a sphere segment is that the contact area is punctual but the body of the projection immediately becomes wider so that the projection body does not press into the material of the guide rail. Therefore, a sphere segment projection is able to transfer high loads to a punctual contact face without damaging the surface of the guide rail, which is preferred in the present invention.

Preferably, the projection formed by the bolt head of the fastening bolt, preferably in the base plate, is larger than the projection on the other walls, e.g. side wall and cover wall, as the force applied by the guide rail acting on the projection of the base wall is presumably the largest.

Although any projections may be embodied as is projection bolts having a sphere segment bolt head and being mounted with their corresponding bolt shaft in the respective wall or by similar methods, preferably the projections are made by punching. Sphere segment like projections are able to transfer high loads from the guide rail to the fixing clip without damaging the guide rail.

Preferably, projections of the fixing clip could be made by punching, which is easy and economical to perform.

Preferably, the base wall is perpendicular to the side wall which guarantees that the projection of the side wall comes easily into contact with the side edge of the guide rail.

The invention also relates to an elevator having at least one guide rail fixing clip according to the above specification as part of a guide rail fixing bracket located in an elevator runway, preferably an elevator shaft. Usually, a guide rail fixing bracket has two guide rail fixing clips mounted opposite to each other to encompass the opposite side edges of a guide rail. The guide rail has usually a T-form and the two guide rail clips are configured to encompass the two opposite side edges of the base member of the T, whereas the central member of the T is gripped by roller of the elevator car.

It is clear for the skilled person that the above-mentioned embodiments of the invention can be combined with each other arbitrarily.

Following terms are used as a synonym: "elevator guide rail fixing clip" and "fixing clip".

The invention also relates to a method for mounting a vertically extending elevator guide rail using an elevator guide rail fixing clip according to the above-mentioned specification. According to this method, following steps are performed successively:

a) the fixing clip is mounted to the guide rail which has been located before in the elevator shaft,
b) two fixing clips mounted on the opposite sides of the guide rail according to step a) are mounted to a bracket member of a guide rail fixing bracket, which bracket member is usually a kind of horizontal extending profile or beam, and
c) the bracket member is mounted to a fixed structure in the elevator runway, e.g. in the elevator shaft.

The bracket member is for example mounted to the elevator shaft or to a metal support structure in the elevator shaft. Via this succession of steps, a secure fixing of the guide rail in the horizontal plane is realized whereas this fixing allows a vertical sliding of the guide rail to compensate for length differences between the building and the guide rail, eventually even for thermal differing expansion coefficients, but particularly because of building shrinkage. It is clear for the skilled person, that single components mentioned in the claim may be arranged as a single component or as multiple components. Thus, a guide rail fixing bracket may comprise two, three or four fixing clips. The fastening bolt may also be fixed to another wall or edge of the clip body.

BRIEF DESCRIPTION OF THE DRAWINGS

The invention is now described in detail by the aid of the schematic drawing.

DESCRIPTION OF THE PREFERRED EMBODIMENTS

Figure 2:
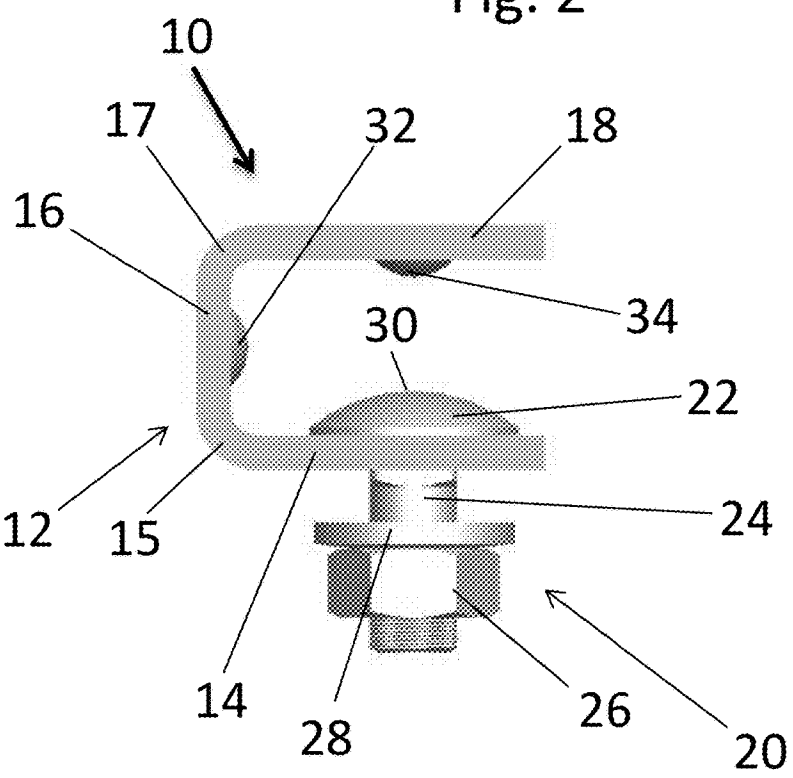
FIG. 2 shows a side view of the fixing clip of FIG. 1.
Figure 1:
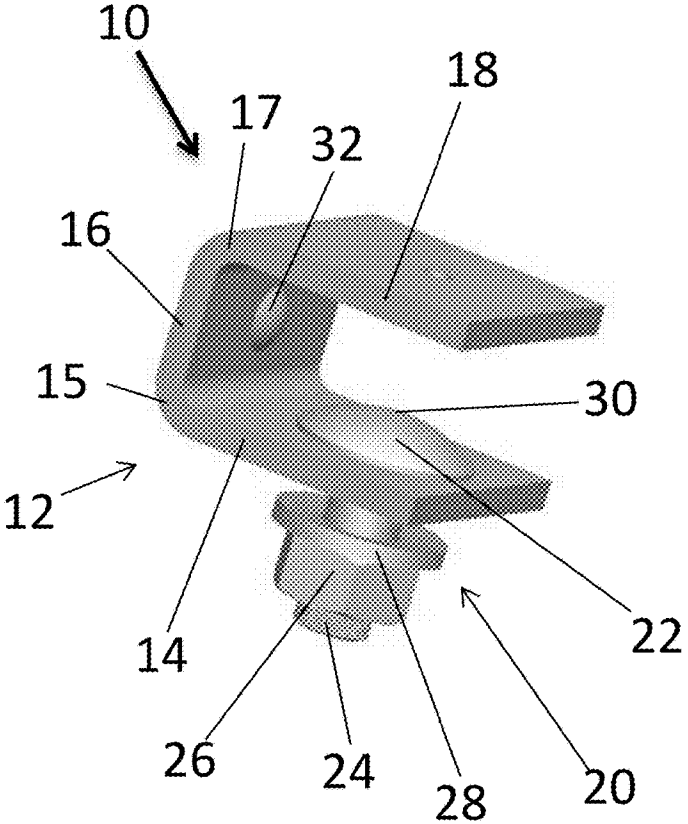
FIG. 1 shows a perspective view of an inventive elevator guide rail fixing clip.
Figure 3:
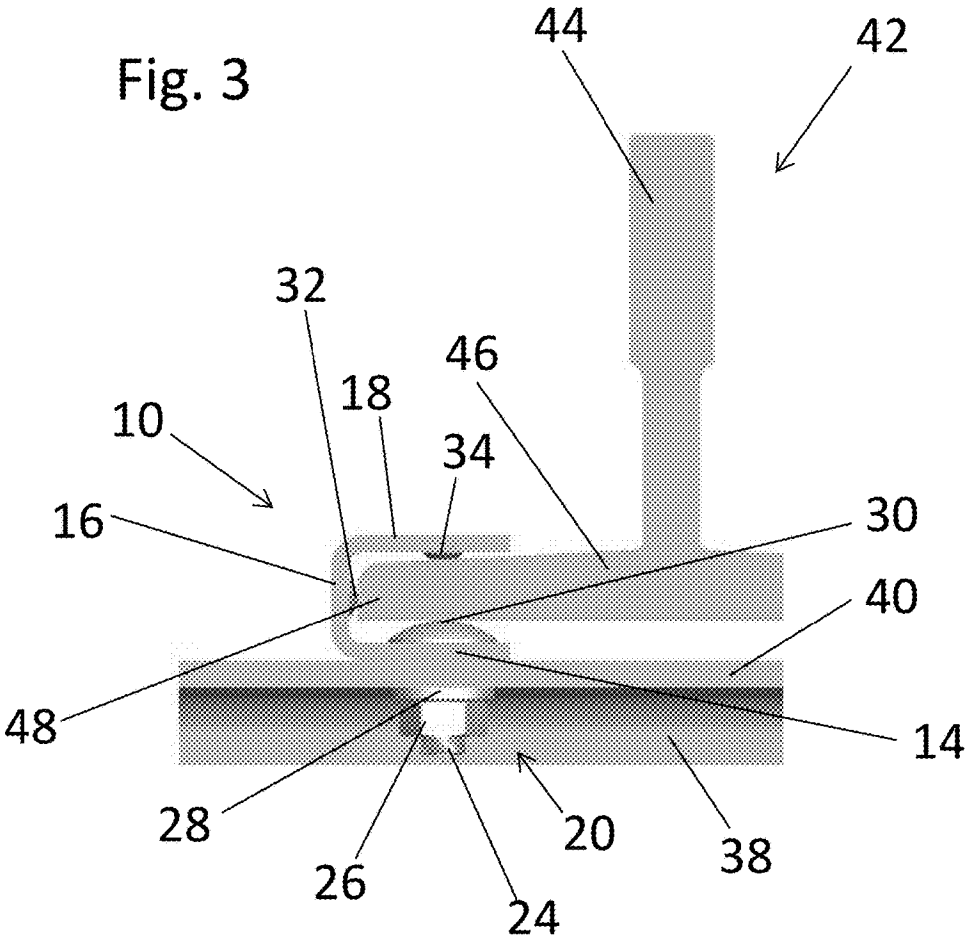
FIG. 3 shows a side view of the fixing clip of FIGS. 1 and 2 encompassing a side edge of a guide rail and mounted to a guide rail fixing bracket.

The inventive elevator guide rail fixing clip is now described via FIGS. 1 to 3. The fixing clip 10 comprises a u-shaped clip body 12 consisting of a base wall 14, a side wall 16 and a cover wall 18. The side wall 16 is connected to the base wall 14 along a first edge 15 and the side wall is connected to the cover wall 18 along a second edge 17, which two edges 15,17 are parallel to each other. Thus, the cover wall 18 and the base wall 14 are about parallel to each other and are connected via the edges 15, 17 to the sidewall 16 which extends perpendicular to them. The u-shaped clip body 12 is a one piece body made of a metal sheet bent along the first and second edge 15, 17 and having a thickness of preferably 2 to 15 mm, particularly 3 to 10 mm. The base wall is penetrated by a fastening bolt 20 having a sphere segment bolt head 22 and a threaded bolt shaft 24 to which a nut 26 and a washer 28 can be mounted to fix the fixing clip 10 to a fixed structure 38 in an elevator runway, for example to a fixing bracket. The tip 30 of the sphere segment bolt head 22 provides a punctual contact face for a guide rail 42. Also the side wall 16 carries side projection 32 and the cover wall 18 carry an upper projection 34 which are preferably made by punching. The side projection and upper projection 32, 34 have a sphere-segment geometry. Accordingly, the side projection and cover projection 32, 34 are made in the corresponding walls 16, 18 in a very simple but reliable manner.

FIG. 3 shows a part of a fixing bracket having a bracket member 38 extending horizontally which bracket member 38 is fixed to an elevator shaft structure in a not shown manner. The fixing clip 10 is mounted to the bracket member 38 via the fastening bolt 20 which penetrates a perforation, preferably a horizontal long hole, in the support wall 40 of the bracket member 38. The horizontal long hole of the bracket member allows the mounting of two fixing clips 10 with adjustable mutual distance.

The vertical extending guide rail 42 is a conventional T-profile having a central member 44 which is mounted to the center of a base member 46. The two fixing clips 10 encompass the outer side edges 48 of the guide rail 42 so as to fix the guide rail in the horizontal plane. Thereby, the tip 30 of the bolt head 22 of the fastening bolt 20, of the side projection 32, as well as of the upper projection 34 come into contact with the base member 46 of the guide rail 42. Therefore, the fixing clip contacts the guide rail 42 only at three points which leads to a reduced frictional force that allows an easy vertical sliding of the guide rail 42 with respect to the fixing clips 10. Preferably, the clip body 12 of the fixing clip 10 is made of a spring metal sheet so that between the tip 30 of the bolt head 22 of the fastening bolt 20 and of the upper projection 34, a certain defined clamping force is applied to the base member 46 of the guide rail 42 for securing the guide rail against the bracket member 38.

The invention can be varied within the scope of the appended patent claims. Particularly, the fixing clip may have more than one projection at each wall 14, 16, 18. Furthermore, the clip body 12 must not exactly be a u-shape, but may also be a v-shape or the side wall may have a round shape instead of flat shape as shown in FIGS. 1 to 3.

LIST OF REFERENCE NUMBERS

10 fixing clip
12 clip body
14 base wall
15 first edge
16 side wall
17 second edge
18 cover wall
20 fastening bolt
22 sphere segment bolt head
24 bolt shaft
26 nut
28 washer
30 tip of bolt head
32 side projection
34 upper projection
38 bracket member
40 support wall of bracket member
42 guide rail
44 central member
46 base member
48 outer side edge of base member of guide rail

The invention claimed is:

1. An elevator guide rail fixing system, comprising:

the elevator guide rail; and an elevator guide rail fixing clip, comprising:

a u-shaped clip body configured to encompass a side edge of the elevator guide rail; and a fastening element including a bolt and a bolt head, the fastening element being fastened to the clip body and configured to mount the clip body to a fixed structure of an elevator runway, wherein the clip body comprises a base wall, a cover wall, and a side wall connecting the base wall and the cover wall, the base wall, the side wall and the cover wall forming three members of the u-shaped body, and the fastening element is fastened to the base wall of the clip body, and wherein the bolt head forms a projection protruding from the base wall and configured to contact the guide rail via a contact face being a tip of the bolt head.

2. The elevator guide rail fixing system according to claim 1, wherein the contact face is a rounded element.

3. The elevator guide rail fixing system according to claim 1, wherein the side wall is connected to the base wall at a first edge and the cover wall is fixed to the side wall at a second edge which is parallel to the first edge.

4. The elevator guide rail fixing system according to claim 3, wherein a distance between the cover wall and the base wall on a side of a free edge, opposite to the second edge, of the cover wall is equal to or smaller than a distance between base wall and cover wall on a side of the second edge.

5. The elevator guide rail fixing clip according to claim 1, wherein the side wall and the cover wall each further include a projection different from the projection formed by the bolt head.

6. The elevator guide rail fixing clip according to claim 5, wherein the projection formed by the bolt head of the bolt is larger than the projections in the side wall and cover wall.

7. The elevator guide rail fixing system according to claim 1, wherein the projection is a sphere segment.

8. The elevator guide rail fixing system according to claim 1, wherein the u-shaped clip body is a one-piece part.

9. The elevator guide rail fixing system according to claim 8, wherein the one piece part is a metal sheet with a thickness of 2 to 15 mm.

10. The elevator guide rail fixing system according to claim 8, wherein the one piece part is a spring metal sheet.

11. An elevator, comprising:

at least one of the elevator guide rail fixing system according to claim 1, wherein the elevator guide rail fixing clip of the at least one of the elevator guide rail fixing system is part of a guide fixing bracket located in an elevator runway.

12. The elevator according to claim 11, wherein each guide fixing bracket has two guide rail fixing system mounted to a horizontally extending bracket member of the guide fixing bracket opposite to each other.

13. A method for mounting an elevator guide rail, said method comprising the steps of:

providing two of the elevator guide rail fixing clips of the elevator guide rail fixing system according to claim 1;

mounting the two fixing clips to opposite sides of the guide rail, respectively;

mounting the two fixing clips to a bracket member of a guide fixing bracket; and mounting the bracket member to a fixed structure in the elevator runway.

14. The elevator guide rail fixing system according to claim 8, wherein the one piece part is a metal sheet with a thickness of 3 to 10 mm.

15. The elevator guide rail fixing system according to claim 2, wherein the side wall is connected to the base wall at a first edge and the cover wall is fixed to the side wall at a second edge which is parallel to the first edge.

16. The elevator guide rail fixing system according to claim 15, wherein a distance between the cover wall and the base wall on a side of a free edge, opposite to the second edge, of the cover wall is equal to or smaller than a distance between base wall and cover wall on a side of the second edge.

* * * * *